US005099663A

United States Patent [19]

Dearstine

[11] Patent Number: 5,099,663

[45] Date of Patent: Mar. 31, 1992

[54] CABINET LOCK SLEEVE APPARATUS

[76] Inventor: Walter R. Dearstine, W. 5206 Sharps Ridge Rd., McConnelsville, Ohio 43756

[21] Appl. No.: 688,977

[22] Filed: Apr. 22, 1991

[51] Int. Cl.[5] ..... E05B 65/00

[52] U.S. Cl. ..... 70/77; 70/85; 70/78; 70/417

[58] Field of Search ..... 70/30, 49, 77, 78, 82-84, 70/381, DIG. 43, DIG. 56, DIG. 20, 452, 417, 70, 81, 85, 56; 312/219; 24/303

[56] References Cited

U.S. PATENT DOCUMENTS

| | | | |
|---|---|---|---|
| 2,913,296 | 11/1959 | Martin | 70/78 |
| 3,408,771 | 11/1968 | Garrett et al. | 292/251.5 |
| 3,559,429 | 2/1971 | Hermann | 70/85 |
| 4,092,056 | 5/1978 | Signore et al. | 312/219 |
| 4,448,049 | 5/1984 | Murray | 70/58 |
| 5,000,498 | 3/1991 | Upchurch | 70/416 |

FOREIGN PATENT DOCUMENTS

| | | | |
|---|---|---|---|
| 1190428 | 5/1970 | United Kingdom | 24/303 |

*Primary Examiner*—Renee S. Luebke
*Assistant Examiner*—Darnell Boucher
*Attorney, Agent, or Firm*—Leon Gilden

[57] ABSTRACT

An apparatus for fixedly mounting to a filing cabinet a locking plunger to prevent inadvertent depressing of the locking plunger relative to the filing cabinet to prevent inadvertent locking of the filing cabinet. The organization includes a lock member defined by an elongate central cavity, with the central cavity of a predetermined length greater than a predetermined height of an associated lock plunger. The lock member includes a rear wall formed with threaded bore, and a set screw directed to the rear bore, whereupon mounting of the lock member receives the cabinet plunger lock within the elongate cavity permitting projection of an associated set screw to engage and secure the associated plunger. A modification of the invention includes a guide bore positioned above the threaded bore to receive a drill bit therethrough to direct a drill bit member to form a blind bore within the plunger lock to subsequently receive the set screw therewithin.

2 Claims, 4 Drawing Sheets

CABINET LOCK SLEEVE APPARATUS

BACKGROUND OF THE INVENTION

1. Field of the Invention

The field of invention relates to lock apparatus, and more particularly pertains to a new and improved cabinet lock sleeve apparatus wherein the same permits securement of the plunger lock of an associated filing cabinet preventing inadvertent depressing of the plunger lock.

2. Description of the Prior Art

Filing cabinets typically utilize a plunger lock directed through a forward wall of the filing cabinet adjacent a top wall to effect locking of the filing cabinet. During the course of a working day and the like, the plunger lock is frequently inadvertently depressed effecting locking of the filing cabinet, whereupon a need for finding of a key results in prolonged delay in use of the filing cabinet. The prior art has utilized various lock members for securing panels and the like relative to one another, as exemplified for example in U.S. Pat. No. 4,768,360 to Foshee utilizing a lock member arranged for preventing sliding panels for effecting relative movement relative to one another.

U.S. Pat. No. 4,887,444 to Elzenbroek, et al. provides for a locking means utilized for a bicycle for securing a framework of the bicycle.

U.S. Pat. No. 4,009,599 to Patriquin sets forth a plunger lock, as is typically utilized in a filing cabinet structure.

U.S. Pat. No. 3,919,866 to Lipschutz sets forth a further example of a key operated push button lock for use in buildings, metallic furniture such as filing cabinets, and the like.

As such, it may be appreciated that there continues to be a need for a new and improved cabinet lock sleeve apparatus as set forth by the instant invention which addresses both the problems of ease of use as well effectiveness in construction in mounting of the apparatus to a plunger lock or a filing cabinet prevent inadvertent depressing of the filing cabinet plunger lock.

SUMMARY OF THE INVENTION

In view of the foregoing disadvantages inherent in the known types of lock apparatus now present in the prior art, the present invention provides a cabinet lock sleeve apparatus wherein the same utilizes a lock member providing a cavity to receive a plunger lock and thereafter security lock member to the plunger lock preventing its inadvertent depression. As such, the general purpose of the present invention, which will be described subsequently in greater detail, is to provide a new and improved cabinet lock sleeve apparatus which has all the advantages of the prior art lock apparatus and none of the disadvantages.

To attain this, the present invention provides an apparatus for fixedly mounting to a filing cabinet a locking plunger to prevent inadvertent depressing of the locking plunger relative to the filing cabinet to prevent inadvertent locking of the filing cabinet. The organization includes a lock member defined by an elongate central cavity, with the central cavity of a predetermined length greater than a predetermined height of an associated lock plunger. The lock member includes a rear wall formed with threaded bore, and a set screw directed to the rear bore, whereupon mounting of the lock member receives the cabinet plunger lock within the elongate cavity permitting projection of an associated set screw to engage and secure the associated plunger. A modification of the invention includes a guide bore positioned above the threaded bore to receive a drill bit therethrough to direct a drill bit member to form a blind bore within the plunger lock to subsequently receive the set screw therewithin.

My invention resides not in any of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cabinet lock sleeve apparatus which has all the advantages of the prior art lock apparatus and none of the disadvantages.

It is another object of the present invention to provide a new and improved cabinet lock sleeve apparatus which may be easily and efficiently manufactured and marketed.

It is a further object of the present invention to provide a new and improved cabinet lock sleeve apparatus which is of a durable and reliable construction.

An even further object of the present invention is to provide a new and improved cabinet lock sleeve apparatus which is susceptible of a low cost of manufacture with regard to both materials and labor, and which accordingly is then susceptible of low prices of sale to the consuming public, thereby making such cabinet lock sleeve apparatus economically available to the buying public.

Still yet another object of the present invention is to provide a new and improved cabinet lock sleeve apparatus which provides in the apparatuses and methods of the prior art some of the advantages thereof, while simultaneously overcoming some of the disadvantages normally associated therewith.

Still another object of the present invention is to provide a new and improved cabinet lock sleeve apparatus wherein the same is arranged for securement to an associated plunger lock of an associated filing cabinet preventing its inadvertent depressing and locking of the associated filing cabinet organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
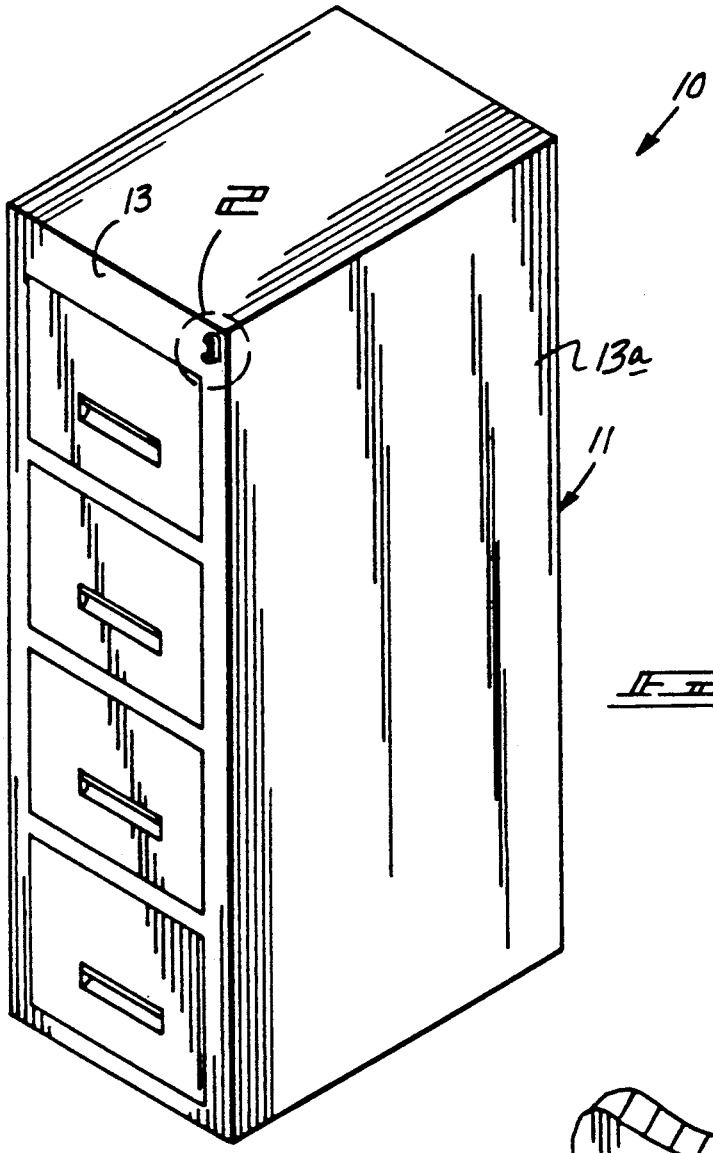
FIG. 1 is an isometric illustration of the instant invention.
Figure 2:
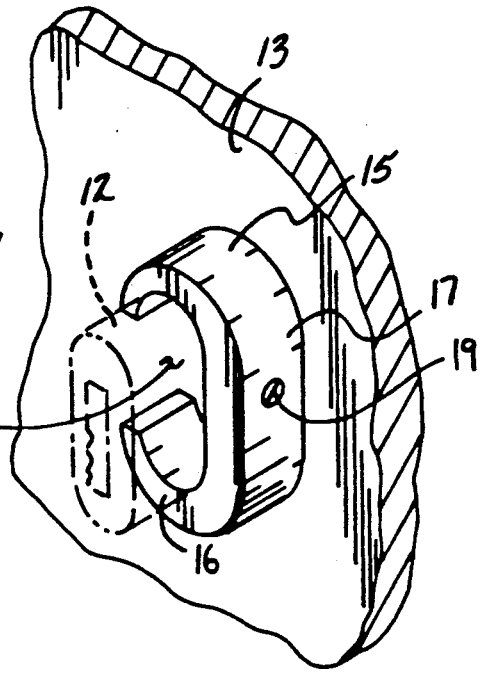
FIG. 2 is an isometric enlarged view of the invention as indicated in FIG. 1.
Figure 3:
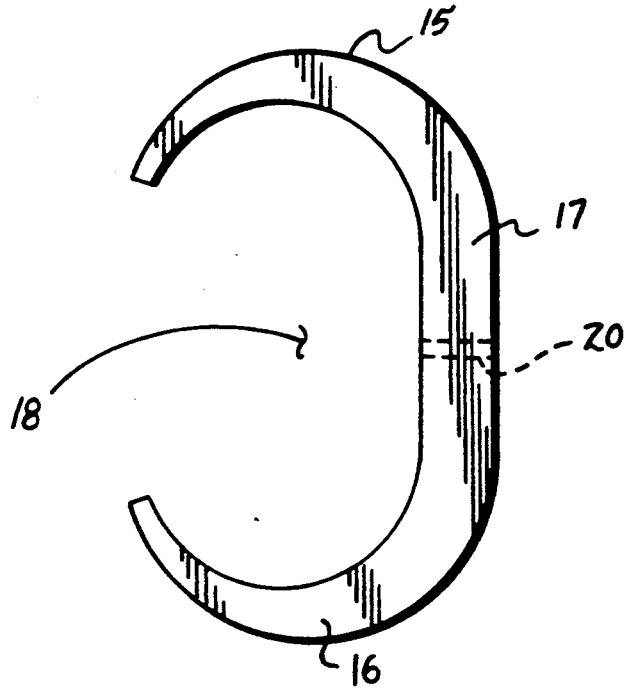
FIG. 3 is an orthographic frontal view of the invention, taken in elevation.
Figure 4:
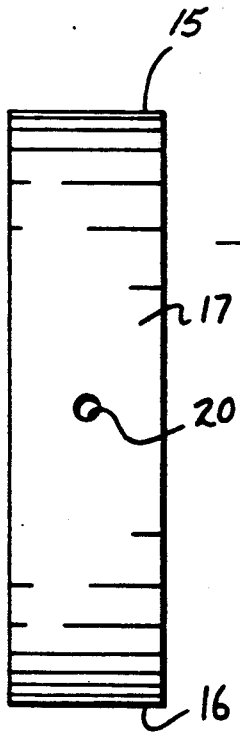
FIG. 4 is an orthographic rear view, taken in elevation, of the instant invention.

With reference now to the drawings, and in particular to FIGS. 1 to 8 thereof, a new and improved cabinet lock sleeve apparatus embodying the principles and concepts of the present invention and generally designated by the reference numerals 10, 10*a*, and 10*b* will be described.

More specifically, the cabinet lock sleeve apparatus 10 of the instant invention essentially comprises a filing cabinet 11, including a cabinet forward wall 13, spaced cabinet side walls 13*a*, with a cabinet top wall. A plunger lock boss 12 is reciprocatably mounted through the forward wall 13 adjacent a top wall defined by a predetermined height and a predetermined width, as well as a predetermined length extending from the forward wall 13. The predetermined length is defined by a predetermined projecting length when the plunger lock boss 12 projects from the filing cabinet forward wall 13 in an extended first position relative to a retracted second position when the plunger lock is projected within the forward wall 13 locking the filing cabinet, in a manner well known to those of ordinary skill in the art. The "C" shaped lock member 14 of the apparatus 10 includes a central vertical web 17 formed with an upper leg 15 and a lower leg 16 defining an elongate cavity 18 to receive the plunger lock boss 12. The lock member 14 is of a predetermined lock member width substantially equal to the predetermined length of the lock boss 12 in the extended first position. Elongate cavity 18 is defined by a predetermined cavity length greater than the predetermined length of the lock boss 12. The central vertical web 17 includes a threaded bore 20 directed medially and orthogonally through the central vertical web 17 threadedly receiving an externally threaded set screw member 19, wherein the threaded set screw member 19 is directed for projection within the elongate cavity 18 to engage a side wall of the lock boss 12 preventing its inadvertent retraction into a second position.

Figure 5:
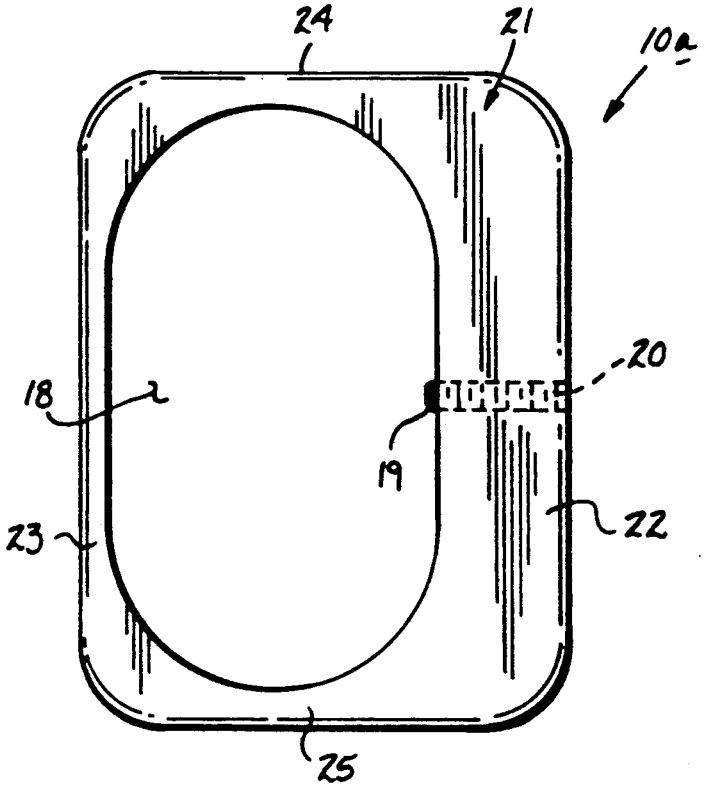
FIG. 5 is an orthographic front view, taken in elevation, of a modification of the instant invention.
Figure 6:
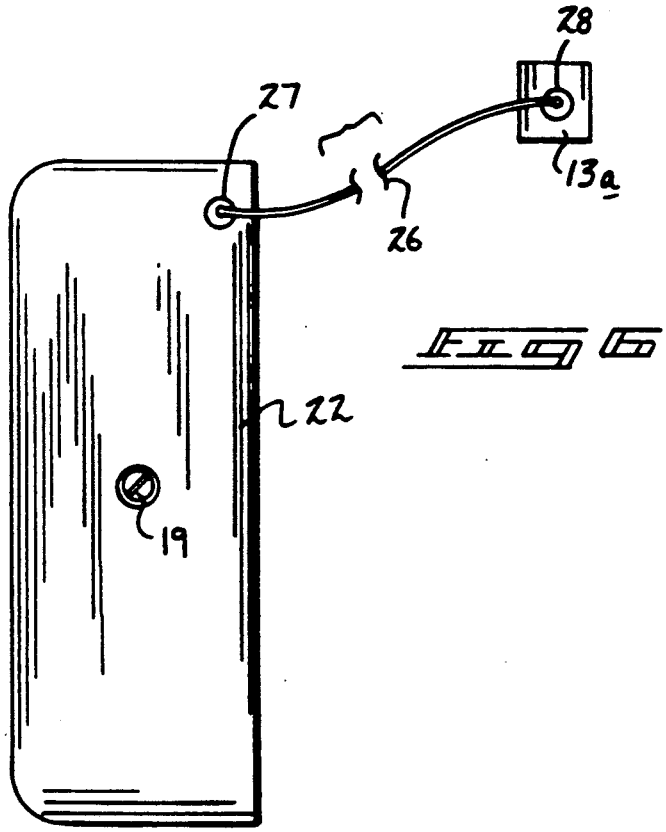
FIG. 6 is an orthographic rear view, taken in elevation, of the modification of the instant invention.

FIG. 5 illustrates a modified apparatus 10*a*, wherein the lock member 21 defines a continuous perimeter wall defined by a rear wall 22, a parallel forward wall 23, a top wall 24, and a bottom wall 25 defining an elongate oval cavity 18 of a like configuration as described above. A flexible tether line 26 is provided, formed with a first magnetic anchor boss 27 of a forward end of the flexible tether line 26 and secured to the lock member 21. A second magnetic anchor boss 28 is mounted to a side wall 13*a* of the filing cabinet preventing inadvertent loss of the lock member 21.

Figure 7:
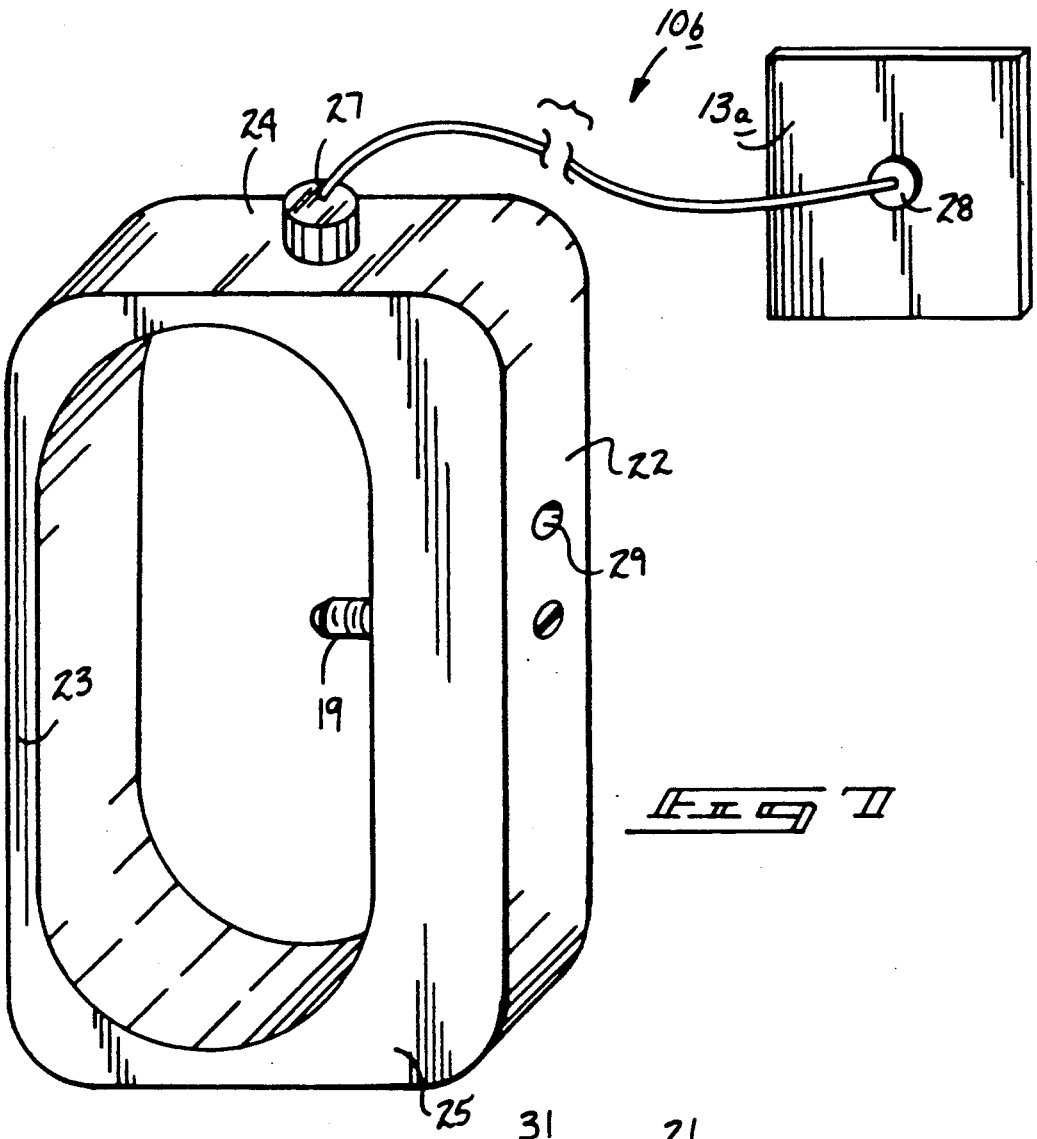
FIG. 7 is an isometric illustration of a further modification of the instant invention.
Figure 8:
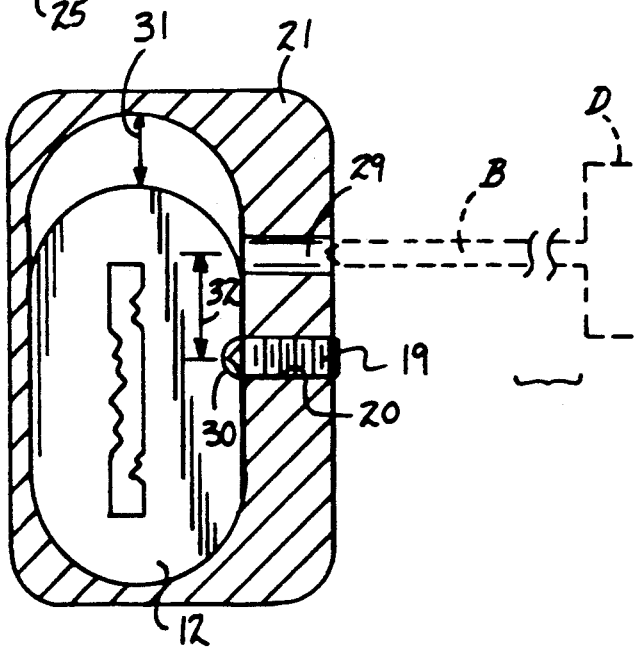
FIG. 8 is an orthographic cross-sectional illustration of the invention for use with an associated drill bit and drill.

The apparatus 10*b*, as illustrated in FIG. 7, further includes a guide bore 29 directed orthogonally through the rear wall 22 above the threaded bore 20. In this manner, the lock member 21 is positioned in a first lowered position, wherein a drill bit "B" mounted to a drill "D" is directed through the guide bore 29 for forming a blind bore 30 within the plunger lock boss 12. Subsequently, the lock member 21 is raised to a lock member second position, whereupon the set screw member 19 is projected into the blind bore 30 for enhanced securement of the lock member 21 relative to the plunger lock boss 12. Accordingly, a first spacing 31 defined between a top surface of the plunger lock boss 12 and a bottom surface of the top wall 24 is substantially equal to a second spacing defined between a threaded bore 20 and the guide bore 29 providing the required positioning for forming of the blind bore 30, as noted above.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A cabinet lock sleeve apparatus, comprising in combination, a filing cabinet, the filing cabinet including a filing cabinet forward wall, spaced side walls, and a filing cabinet top wall, and the filing cabinet including a plunger lock boss reciprocatably mounted within the filing cabinet through the filing cabinet forward wall, wherein the plunger lock boss is reciprocatable from a first extended position to a second retracted lock position within the filing cabinet forward wall, and the plunger lock boss including a predetermined length when the plunger lock boss is in the first extended position, and a predetermined width, and a predetermined height, and including a lock member, the lock member including a continuous perimeter wall, the wall including a rear wall portion, a forward wall portion, a top wall portion, and a bottom wall portion, and the wall including an elongate cavity, the cavity having a cavity width equal to the predetermined width, and the cavity having a predetermined cavity height measured between the top wall portion and the bottom wall portion, and the lock member having a lock member width substantially equal to the predetermined length of the plunger lock boss when the plunger lock boss is in the first extended position, and a predetermined cavity height greater than the predetermined height of the plunger lock boss, and a threaded bore medially and orthogonally directed through the rear wall portion of the lock member, and the threaded bore threadedly receiving an externally threaded set screw member, and further including a flexible tether line, the flexible tether line including a flexible tether line forward end and a flexible tether line rear end, the flexible tether line forward end fixedly secured to a first magnetic anchor, the first magnetic anchor magnetically mounted to the lock member, and the flexible tether line rear end mounted to a second magnetic anchor, the second magnetic anchor mounted to the filing cabinet, and wherein the rear wall portion includes a guide bore, the guide bore being spaced above the threaded bore.

2. An apparatus as set forth in claim 1 wherein the top wall portion of the lock member includes a top wall interior surface, and the plunger lock boss includes a plunger lock boss top surface, and a first spacing defined between a plunger lock boss top surface and the top wall interior surface, and a second spacing is defined between the threaded bore and the guide bore, wherein the first spacing is equal to the second spacing.

* * * * *